US006853829B2

(12) United States Patent
Hoshi et al.

(10) Patent No.: US 6,853,829 B2
(45) Date of Patent: Feb. 8, 2005

(54) MULTI-COLOR PRINTER AND METHOD THEREFOR

(75) Inventors: Nobuyoshi Hoshi, Hitachinaka (JP); Hiroyuki Mabuchi, Hitachinaka (JP)

(73) Assignee: Hitachi Printing Solutions, Ltd., Ebina (JP)

( * ) Notice: Subject to any disclaimer, the term of this patent is extended or adjusted under 35 U.S.C. 154(b) by 60 days.

(21) Appl. No.: 10/318,414

(22) Filed: Dec. 13, 2002

(65) Prior Publication Data

US 2003/0129006 A1 Jul. 10, 2003

(30) Foreign Application Priority Data

Dec. 14, 2001 (JP) ..... 2001-381650

(51) Int. Cl.[7] ..... G03G 15/01
(52) U.S. Cl. ..... 399/299; 399/302; 399/303
(58) Field of Search ..... 399/297, 298, 399/299, 300, 302, 303, 308

(56) References Cited

U.S. PATENT DOCUMENTS

| | | | | |
|---|---|---|---|---|
| 5,075,730 A | * | 12/1991 | Hoshi | 399/302 |
| 5,671,472 A | | 9/1997 | Snelling | 399/308 |
| 6,088,565 A | * | 7/2000 | Jia et al. | 399/302 |
| 6,163,672 A | | 12/2000 | Parker et al. | 399/223 |
| 6,539,194 B2 | * | 3/2003 | Oikawa | 399/299 |
| 6,678,493 B2 | * | 1/2004 | Maeyama et al. | 399/302 |

* cited by examiner

*Primary Examiner*—Susan Lee
(74) *Attorney, Agent, or Firm*—McGinn & Gibb, PLLC

(57) ABSTRACT

A multi-color printer (and a method therefor) includes a drum-shaped photosensitive body for black toner, a belt-shaped toner carrier for non-black color toner, a first transferring unit for transferring a color-toner image formed on the belt-shaped toner carrier to a medium, a second transferring unit for transferring a black toner image formed on the drum-shaped photosensitive body, the drum-shaped photosensitive body being disposed near the belt-shaped toner carrier, and a fusing unit for fusing to the medium the black toner image and the color toner image transferred to the paper.

30 Claims, 2 Drawing Sheets

MULTI-COLOR PRINTER AND METHOD THEREFOR

BACKGROUND OF THE INVENTION

1. Field of the Invention

The present invention relates to a multi-color printer that performs multi-colored printing on paper using black toner and non-black color toner, and more particularly to a multi-color printer capable of printing images at high speeds to a web.

2. Description of the Related Art

In a multi-color printer that uses an electrophotographic process, a single photosensitive body is rotated multiple times. At each rotation, a single color of toner at a time is applied onto the photosensitive body, thereby resulting in the formation of a color image on the photosensitive body by the superimposition of toner images of multiple colors.

With the above configuration, however, a color image cannot be obtained without rotating the photosensitive body multiple times. Thus, multi-color printing takes many (e.g., four) times the time required for single-color printing.

Also, in addition to cut paper (e.g., paper cut in advance to predetermined sizes such as B5, B4, A4, A3, etc.), web paper (e.g., continuous paper rolls) is used in some printing situations. Thus, the arrangement described above requiring the rotating of the photosensitive body multiple times becomes difficult to implement for web paper.

SUMMARY OF THE INVENTION

In view of the foregoing and other problems, drawbacks, and disadvantages of the conventional methods and structures, a purpose of the present invention is to provide a multi-color printer that allows easy color image alignment and that can handle high-speed printing to web paper.

In a first aspect of the invention, a multi-color printer includes a drum-shaped photosensitive body handling black toner, a belt-shaped toner carrier handling non-black color toner, a first transfer mechanism for transferring a color toner image formed on the belt-shaped toner carrier to a paper, a second transfer mechanism for transferring a black toner image formed on the drum-shaped photosensitive body, the drum-shaped photosensitive body being disposed near the belt-shaped toner carrier, and a fusing mechanism for fusing to the paper the black toner image and the color toner image transferred to the paper.

According to another aspect of the invention, the drum-shaped photosensitive body for non-black color toner preferably faces the belt-shaped toner carrier.

According to another aspect of the invention, the belt-shaped toner carrier preferably includes an intermediate transfer belt.

According to another aspect of the invention, the belt-shaped toner carrier preferably includes a photosensitive belt, and the drum-shaped photosensitive body for non-black color toner is preferably disposed facing the photosensitive belt.

According to another aspect of the invention, the first transfer mechanism and the second transfer mechanism preferably include a single transfer roller.

According to another aspect of the invention, the paper preferably includes a web formed as a continuous roll.

According to another aspect of the invention, a diameter of the drum-shaped photosensitive body for black toner is preferably greater than a diameter of a drum-shaped photosensitive body for non-black color toner.

In a further aspect of the invention, a printer preferably includes a transfer device for transferring an image to a paper, a belt-shaped toner carrier contacting the transfer device, and a drum-shaped photosensitive body contacting the transfer device. The belt-shaped toner carrier transfers at least one non-black toner to the transfer device.

According to another aspect of the invention, at least one drum-shaped photosensitive body for non-black toner preferably faces the belt-shaped toner carrier.

According to another aspect of the invention, the present invention preferably includes a fuser in contact with the paper leaving the transfer device, the fuser fusing the image to the paper.

According to another aspect of the invention, a single revolution of the belt-shaped toner carrier around the transfer device preferably transfers at least two non-black toners to the paper.

According to another aspect of the invention, at least one drum-shaped photosensitive body preferably includes two or more drum-shaped bodies.

According to another aspect of the invention, the two or more drum-shaped bodies preferably dispense two or more colors of non-black toner.

In an additional aspect of the invention, a method of applying toner in a multi-color printer includes transferring a color toner image formed on a belt-shaped toner carrier to a paper, transferring a black toner image formed on a first drum-shaped photosensitive body to the paper, and fusing to the paper the black toner image and the color toner image.

According to another aspect of the invention, the second drum-shaped photosensitive body preferably includes two or more drum-shaped bodies, each transferring a different color toner image to the belt-shaped toner carrier.

According to another aspect of the invention, transferring a color image in a method of the invention preferably transfers at least one non-black toner to the paper in a single revolution of the belt-shaped toner carrier.

According to another aspect of the invention, the two or more drum-shaped bodies preferably are aligned linearly to each other and parallel to the belt-shaped toner carrier.

The above, and other purposes, features and advantages of the present invention will become apparent from the following description read in conjunction with the accompanying drawings, in which like reference numerals designate the same elements.

The present disclosure relates to subject matter contained in Japanese Patent Application No. 2001-381650, filed on Dec. 14, 2001 which is expressly incorporated herein by reference in its entirety.

BRIEF DESCRIPTION OF THE DRAWINGS

The foregoing and other purposes, aspects and advantages will be better understood from the following detailed description of preferred embodiments of the invention with reference to the drawings, in which.

DETAILED DESCRIPTION OF PREFERRED EMBODIMENTS OF THE INVENTION

Figure 1:
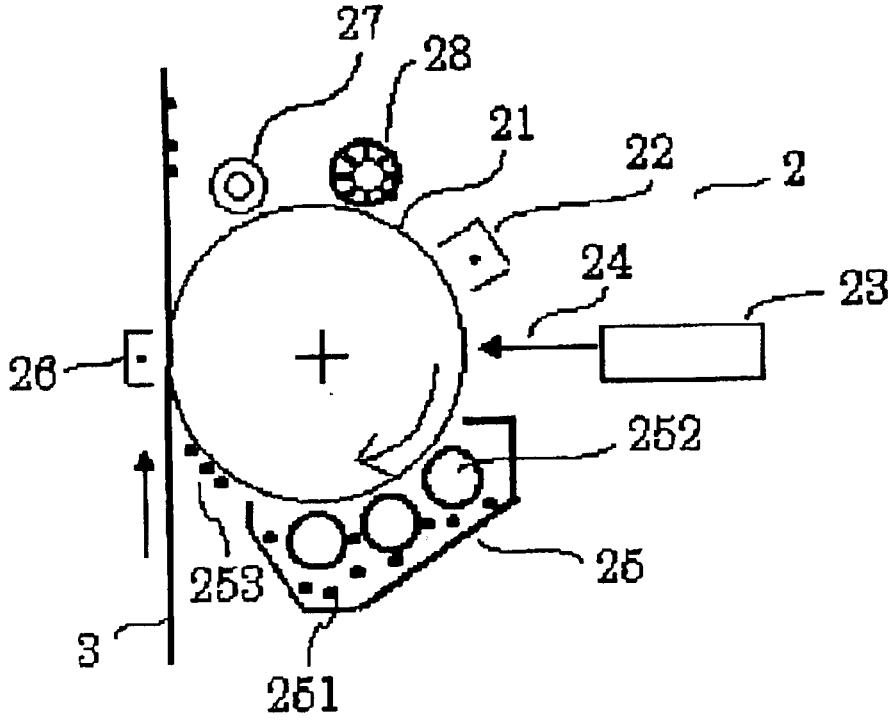
FIG. 1 is a simplified drawing of a printing unit according to the present invention.

Referring now to the drawings, and more particularly to FIGS. 1–5, there are shown preferred embodiments of the structures and method according to the present invention.

Preferred Embodiments

FIG. 1 illustrates an example of a printing unit in which a multi-color printer according to the present invention is implemented. In a printing unit 2, a charger 22 applies an electrostatic charge to a drum-shaped photosensitive body 21. As shown in FIG. 1, the photosensitive body 21 rotates clockwise and a laser beam 24 applied from an optical system 23 forms an electrostatic latent image thereon. This electrostatic latent image is then sent to a developing area including developer device 25.

The developer device 25 is filled with a two-element developer agent 251 containing a magnetic carrier and a toner (e.g., not shown). The above-described electrostatic latent image is developed with the developing agent supplied by a developer roller 252. As a result, a toner image 253 is formed on the photosensitive body 21.

The toner image 253 is transferred electrostatically to a transfer body 3 through a corona discharge via a transfer device 26. Once the toner image 253 is transferred to the transfer body 3, the electrostatic charge on the surface of the photosensitive body 21 is removed by an eraser 27, and residual toner is removed with a cleaner 28.

In the printing unit 2, the developer device 25 is disposed below the photosensitive body 21. With this arrangement, toner or carrier falling from the developer device 25 will not affect the photosensitive body 21 or the transfer body 3. Also, as compared to locating the developer device 25 above the photosensitive body 21, this arrangement provides greater reliability and ease of maintenance for the printing unit 2.

Embodiment 1

Figure 2:
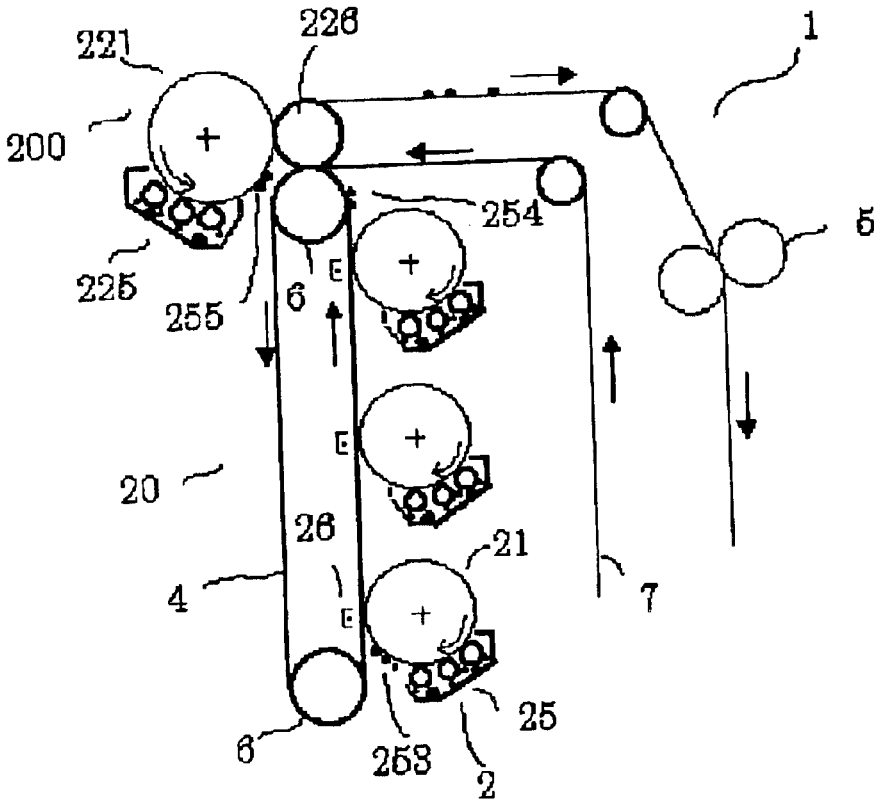
FIG. 2 is a simplified drawing showing a first embodiment of the structure of a multi-color printer according to the present invention.

FIG. 2 shows, in a first embodiment of the present invention, a simplified architecture of a multi-color printer according to the present invention. For clarity and ease of understanding, FIG. 2 shows only the photosensitive body 21, the developer device 25, and the transfer device 26 from FIG. 1 for each of the printing units 2.

In FIG. 2, each of the printing units 2 (e.g., in the non-limiting embodiments as shown in the Figures, for example, three are shown) contains toner for a different color (e.g., cyan, magenta, and yellow). The printing units 2 are linearly arranged vertically relative to the ground (e:g., not shown) and parallel to a belt-shaped toner carrier 4 (e.g., hereinafter referred to as "an intermediate transfer belt"). The intermediate transfer belt 4 receives toner images from the photosensitive body 21 of each of the printing units 2 and is extended over vertically arranged rollers 6 to one side (e.g., to the left in FIG. 2) of the vertically arranged printing units 2.

A color printing station 20 is formed from the printing units 2 and the intermediate transfer belt 4. The intermediate transfer belt 4 moves counter-clockwise (e.g., in a direction counter to the direction in which the photosensitive body 21 is moving), thereby forming a color toner image 254 by sequentially transferring the toner images 253 from the surfaces of the photosensitive body 21.

A black toner printing unit 200 for handling black toner is installed at a position close to (e.g., adjacent) a side of the intermediate transfer belt 4 near a roller 6 and opposite a side of the intermediate transfer belt 4 on which the printing unit 2 is located. The distance between the photosensitive body 221 of the black toner printing unit 200 and the intermediate transfer belt 4 (e.g., the distance from the roller 6 furthest from the ground in a vertical direction), can be set to a few centimeters or less.

The diameter of the black-toner photosensitive body 221, which is used frequently, is set to be greater than the diameter of the color-toner photosensitive bodies 21. The developer device 225 of the printing unit 200 is disposed below (e.g., on a side closest to the ground in the vertical direction) the black-toner photosensitive body 221. The photosensitive body 221 rotates counter-clockwise in FIG. 2 and forms a black toner image 255.

A web 7 sent from a paper feeder module (e.g., not shown) passes in a direction parallel to the transfer belt 4 (e.g., to the right of the color printing station 20, as shown in FIG. 2) and is transported in a vertical direction upward from the ground. Then the paper changes direction (e.g., at approximately a right angle) towards the developer device 225 and the printing unit 200.

The color toner image 254 is transferred to the web 7 by the transfer roller 226 at an end of the intermediate transfer belt 4 furthest from the ground in a vertical direction (e.g., the top of the transfer belt 4). The black toner image 255 is transferred to the web 7 by the transfer roller 226 on a side of the photosensitive body 221. Next, the web 7 changes direction by moving around transfer roller 226, and fusing is performed by a fuser device 5 installed at a position on a side of the color printing station 20.

A characteristic of the first embodiment is that the intermediate transfer belt 4 of the color printing station 20 and the drum-shaped photosensitive body 221 can be installed very close together, even though the color printing station 20 is installed separately from the black-toner printing unit 200, which is more frequently used. As a result, misalignment between the color toner image 254 and the black toner image 255, caused by meandering of the web or the like, is avoided.

Another characteristic of the first embodiment is that the developer devices 25 of the color toner printing units 2 and the developer device 225 of the black toner printing unit 200 are disposed below (e.g., at a position closest to the ground in a vertical direction) their respective printing units. This positioning of the developer devices is advantageous for high-speed developing.

Embodiment 2

Figure 3:
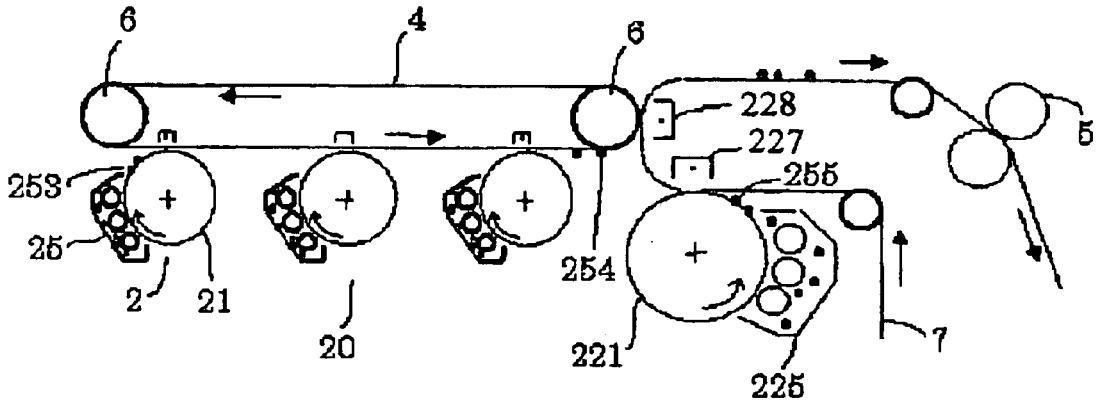
FIG. 3 is a simplified drawing showing a second embodiment of the structure of a multi-color printer according to the present invention.

FIG. 3 illustrates a second embodiment of the present invention, which is somewhat similar to the first embodiment shown in FIG. 2.

However, a significant difference between the first embodiment and the second non-limiting embodiment, as shown in FIG. 3, is the installation of the color printing station 20, which includes the intermediate transfer belt 4 positioned close to the black-toner photosensitive body 221 and extending in a horizontal direction relative to the ground, above the black-toner printing unit 200 (e.g., further from the ground than the black-toner printing unit 200) and to one side of the black-toner printing unit 200 (e.g., to the left, as shown in FIG. 3).

In FIG. 3, the black-toner developer device 225 is installed at a position on a side of the black-toner photosensitive body 221 which is opposite the side where the intermediate transfer belt 4 is closely positioned.(e.g., to the right of the black-toner photosensitive body 221). The black-toner photosensitive body 221 rotates (e.g., counter-clockwise as shown in FIG. 3), and forms a black toner image 255.

The three color-toner printing units 2 are disposed on a side of the intermediate transfer belt 4 closest to the ground (e.g., below the intermediate transfer belt 4). The intermediate transfer belt 4 moves in a same direction as the black-toner photosensitive body 221 (e.g., counter-clockwise as shown in FIG. 3). The color toner image 254 is formed by sequentially superimposing toner images 253 formed by the color developer devices 25 installed (e.g., to the left) on a side of the photosensitive bodies 21, rotating clockwise, away from the black-toner photosensitive body 221.

On a same side of the black-toner printing unit 200 on which the black-toner developer device 225 is installed (e.g., to the right), the web 7 is transported upward (e.g., in a vertical direction away from the ground), and then changes direction (e.g., at approximately a right angle) towards the printing unit 200 (e.g., to the left as shown in FIG. 3).

The transfer of the black toner image 255 to the web 7 is performed by the corona transfer device 227, and occurs above (e.g., in a vertical direction from the ground) the black-toner photosensitive body 221. The transfer of the color toner image 254 to the web 7 is performed by the corona transfer device 228 and takes place at a side of the intermediate transfer belt 4 nearest the black-toner photosensitive body 221 (e.g., to the right as shown in FIG. 3).

Next, the web 7 changes direction, and fusing is performed by a fusing device 5 installed at a position on a side of the black-toner printing unit 200.

A characteristic of the second embodiment is that the height dimension (e.g., a distance in a vertical direction from the ground) of the full-color electrophotographic device 1 is kept low (e.g., small) since the color printing units 2 are arranged horizontally (e.g., parallel) in relationship to the ground.

With high-speed tandem printing, the dimensions of the individual printing units are large, thus increasing the overall height of the device if these printing units are arranged vertically. As a result, adjustments and maintenance of the upper printing units become difficult. In contrast, the structure of a device according to the second embodiment provides easy adjustment and maintenance of the printing units.

Embodiment 3

Next, a third non-limiting embodiment of the present invention will be described referring to FIG. 4. This embodiment relates to spot-color printing devices used for two-color printing (e.g., red and black, or blue and black, etc.). A difference between the third embodiment shown in FIG. 4 and the first embodiment shown in FIG. 2 is the use of a photosensitive belt 310 as the belt-shaped toner carrier for color printing.

Figure 4:
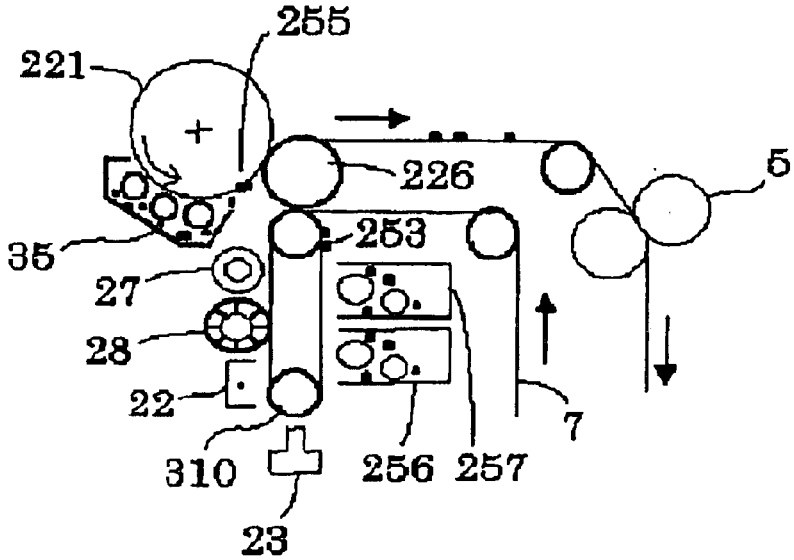
FIG. 4 is a simplified drawing showing a third embodiment of the structure of a multi-color printer according to the present invention.

The photosensitive belt 310 moves in a same rotational direction as the black-toner photosensitive body 221 (e.g., counter-clockwise as shown in FIG. 4). In the vicinity of the photosensitive body 310 are disposed an electrostatic device 22, an optical system 23, a first color-toner (e.g., blue-toner) developer device 256, a second color-toner (e.g., red-toner) developer device 257, an eraser 27, and a cleaner 28.

The toner image 253 is formed by activating the blue-toner developer device 256 for blue-black two-color printing and by activating the red-toner developer device 257 for red-black two-color printing. The web 7 is transported upwardly (e.g., in a vertical direction away from the ground) on a side of the photosensitive belt 310 away from the cleaner 28 (e.g., to the right as shown in FIG. 4, and then changes direction (e.g., at approximately a right angle) moving towards the photosensitive belt 310 (e.g., to the left as shown in FIG. 4).

The transfer of the toner image 253 to the web 7 is performed by the transfer roller 226, and occurs above the photosensitive belt 310 (e.g., in a vertical direction from the ground). The transfer of the black toner image 255 to the web 7 is performed by the transfer roller 226, and occurs on a side (e.g., to the right as shown in FIG. 4) of the black-toner photosensitive body 221 on which the photosensitive belt 310 is located. Next, the transport direction of the web 7 is changed, and fusing is performed by the fuser device 5 installed on a side of the color printing station 20.

With this embodiment, the use of the photosensitive belt 310 for color toners in two-color printing devices, where a limited number of colors is used, provides the possibility for installing the photosensitive belt 310 and the drum-shaped black-toner recording body 221 very close together. As a result, misalignment in two-color printing caused by meandering of the web or the like, can be avoided.

Also, since the photosensitive belt 310 is used rather than a photosensitive drum, developer devices having completely identical structures may be installed next to each other, thereby allowing easy selection of toner colors.

Embodiment 4

Next, a fourth embodiment of the present invention will be described referring to FIG. 5.

This embodiment relates to an electrophotographic recording device for performing two-color printing such as red-black and blue-black printing. A difference between the non-limiting embodiment of FIG. 5 and the second embodiment of FIG. 3 is that the toner carrier belt for color printing is a photosensitive body in the form of a photosensitive belt 310.

Figure 5:
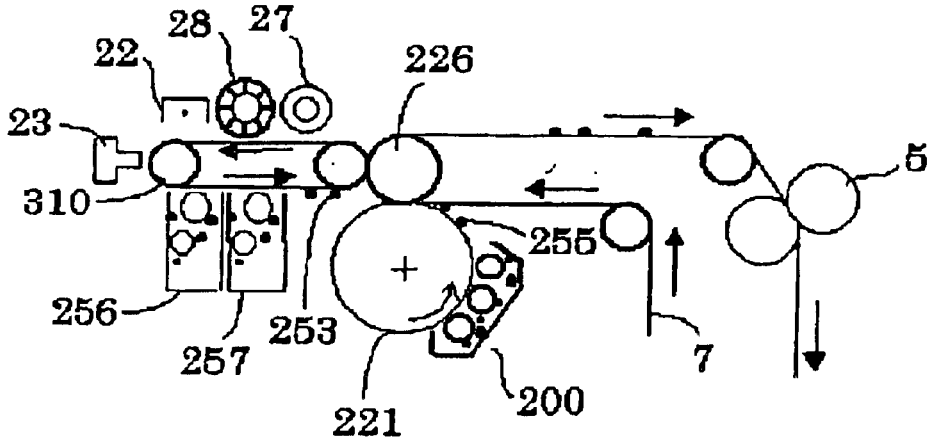
FIG. 5 is a simplified drawing showing a fourth embodiment of the structure of a multi-color printer according to the present invention.

The photosensitive belt 310 moves in a same rotational direction as a black-toner recording body 221 (e.g., counter-clockwise as shown in FIG. 5). In the vicinity of the photosensitive belt 310 are disposed an electrostatic device 22, an optical system 23, a blue-toner developer device 265, a red-toner developer device 257, an eraser 27, and a cleaner 28.

The toner image 253 is formed by activating the blue-toner developer device 256 for blue-black two-color printing and by activating the red-toner developer 257 for red-black two-color printing. To the side (e.g., to the right as shown in FIG. 5) of the black-toner printing unit 200, a web 7 is drawn out from a feeder module (e.g., not shown) and transported upwardly (e.g., in a vertical direction away from the ground). The web 7 is then redirected to the left (e.g., at approximately a right angle).

The transfer of the black-toner image 255 to the web 7 occurs using transferring means 226 in the form of a transfer roller above (e.g., in a vertical direction away from the ground) the black-toner recording body 221. The transfer of the toner image 253 occurs at a side of the photosensitive belt 310 away from a side on which the optical system 23 is located.

As in the third embodiment of the present invention as shown in FIG. 4, the fourth embodiment uses the photosensitive belt 310 for color toner in a two-color printing device, where a limited number of colors are used. This allows the photosensitive belt 310 and the drum-shaped recording body 221 for the black toner to be installed very close to each other. As a result, misalignment in two-color printing due to meandering of the web or the like, is avoided.

Also, since the photosensitive belt 310 is used instead of a photosensitive drum, developer devices having completely identical structures can be installed next to each other, thereby allowing color toners to be switched easily.

In the first and second embodiments of the present invention, cyan, magenta, and yellow toner (C, M, and Y) are used for the printing units, but other types of toner such as red toner and blue toner can be used depending on the application and the designer's needs. In the embodiments of the present invention, the descriptions refer to "left" and "right" to facilitate the discussion, but changing the device structure symmetrically results in a structure that is completely equivalent to that of the present invention.

With the present invention described above, color images can be aligned easily. Also, for web printing applications, a high-speed multi-color printer can be provided.

Further, the black printing unit can be installed separately from and close to the color printing units, thus allowing easy alignment of the color images. Since the developer devices are installed either below (e.g., in a vertical direction from the ground) or to the side of the recording bodies, printing can be performed at high speeds, particularly for web printing.

While the invention has been described in terms of several preferred embodiments, those skilled in the art will recognize that the invention can be practiced with modification within the spirit and scope of the appended claims.

Further, it is noted that Applicant's intent is to encompass equivalents of all claim elements, even if amended later during prosecution.

What is claimed is:

1. A multi-color printer, comprising:

a drum-shaped photosensitive body for black toner;

a belt-shaped toner carrier for non-black color toner;

first transferring means for transferring a non-black color toner image formed on said belt-shaped toner carrier to a medium;

second transferring means for transferring a black toner image formed on said drum-shaped photosensitive body, said drum-shaped photosensitive body being disposed near said belt-shaped toner carrier; and fusing means for fusing to said medium said black toner image and said color toner image transferred to said medium.

2. The multi-color printer according to claim 1, further comprising:

at least one drum-shaped photosensitive body for non-black color toner facing said belt-shaped toner carrier.

3. The multi-color printer according to claim 2, wherein a diameter of said drum-shaped photosensitive body for black toner is greater than a diameter of said drum-shaped photosensitive body for non-black color toner.

4. The multi-color printer according to claim 2, further comprising:

a non-black color toner developer device disposed below each of said at least one drum-shaped photosensitive body for non-black color toner.

5. The multi-color printer according to claim 1, wherein said belt-shaped toner carrier comprises an intermediate transfer belt.

6. The multi-color printer according to claim 1, wherein said belt-shaped toner carrier comprises a photosensitive belt.

7. The multi-color printer according to claim 6, comprising:

at least one two-color-toner developer device for two-color spot printing.

8. The multi-color printer according to claim 1, wherein said first transferring means and said second transferring means comprise a single transfer roller.

9. The multi-color printer according to claim 1, wherein said medium comprises a web formed as a continuous roll.

10. The multi-color printer according to claim 1, wherein said belt-shaped toner carrier extends in a direction perpendicular to the ground, and wherein said drum-shaped photosensitive body for black toner is located to a side of said belt-shaped toner carrier.

11. The multi-color printer according to claim 1, wherein said belt-shaped toner carrier extends in a direction parallel to the ground, and wherein said drum-shaped photosensitive body for black toner is located between said belt-shaped toner carrier and the ground and to a side of said belt-shaped toner carrier.

12. The multi-color printer according to claim 1, wherein said belt-shaped toner carrier comprises a photosensitive belt which extends in a direction perpendicular to the ground, and wherein said drum-shaped photosensitive body for black toner is located to a side of said photosensitive belt.

13. The multi-color printer according to claim 1, wherein said belt-shaped toner carrier comprises a photosensitive belt which extends in a direction parallel to the ground, and wherein said drum-shaped photosensitive body for black toner is located between said belt-shaped toner carrier and the ground and to a side of said photosensitive belt.

14. The multi-color printer according to claim 1, further comprising:

a black toner developer device disposed below said drum-shaped photosensitive body for black toner.

15. The multi-color printer according to claim 1, wherein said drum-shaped photosensitive body for black toner is installed separately from said belt-shaped toner carrier.

16. The multi-color printer according to claim 1, wherein said first transferring means and said second transferring means each comprise a corona transfer device.

17. The multi-color printer according to claim 1, wherein said belt-shaped toner carrier carries only non-black toner.

18. A printer, comprising:

a transfer device for transferring an image to a medium;

a belt-shaped toner carrier for non-black color toner contacting said transfer device; and a drum-shaped photosensitive body for black toner contacting said transfer device, wherein said transfer device transfers at least one non-black color toner from said belt-shaped toner carrier to said medium and black toner from said drum-shaped photosensitive body to said medium.

19. The printer according to claim 18, comprising:

at least one drum-shaped photosensitive body for non-black color toner facing said belt-shaped toner carrier.

20. The printer according to claim 19, wherein said at least one drum-shaped photosensitive body comprises two or more drum-shaped bodies.

21. The printer according to claim 20, said two or more drum-shaped bodies dispense two or more colors of non-black color toner.

22. The printer according to claim 18, further comprising:

a fuser in contact with the medium leaving said transfer device, said fuser fusing the image to the medium.

23. The printer according to claim 18, wherein a single revolution of said belt-shaped toner carrier around said transfer device transfers at least two non-black color toners to the medium.

24. The multi-color printer according to claim 18, wherein said belt shaped toner carrier carries only non-black toner.

25. A method of applying toner in a multi-color printer, comprising:

transferring a non-black color toner image formed on a belt-shaped toner carrier to a medium;

transferring a black toner image formed on a drum-shaped photosensitive body to said medium; and fusing to said medium said black toner image and said color toner image.

26. The method according to claim 25, further comprising:

two or more drum-shaped bodies, each transferring a different non-black color toner image to the belt-shaped toner carrier.

27. The method according to claim 26, wherein the two or more drum-shaped bodies are aligned linearly to each other and parallel to the belt-shaped toner carrier.

28. The method according to claim 25, wherein said transferring a non-black color image transfers at least one non-black color toner to the medium in a single revolution of said belt-shaped toner carrier.

29. The method according to claim 25, wherein said medium comprises a web formed as a continuous roll.

30. A multi-color printer, comprising:

a drum-shaped photosensitive body for black toner;

a belt-shaped toner carrier for carrying only non-black color toner;

a first transfer device for transferring a non-black color toner image, formed on said belt-shaped toner carrier, to a medium; and a second transfer device for transferring a black toner image formed on said drum-shaped photosensitive body to said medium, said drum-shaped photosensitive body being disposed near said belt-shaped toner carrier.

* * * * *